US005906012A

United States Patent [19]

Sakane et al.

[11] Patent Number: 5,906,012

[45] Date of Patent: May 25, 1999

[54] AUTOMATIC SHAMPOO MACHINE

[75] Inventors: Tetsuo Sakane, Otsu; Hideaki Matsunaga, Kusatsu; Takenari Yuki, Shiga-ken; Masaru Noro, Otsu; Mitsuru Naganawa, Joyo, all of Japan

[73] Assignee: Sanyo Electric Co. Ltd., Osaka, Japan

[21] Appl. No.: 08/998,818

[22] Filed: Dec. 29, 1997

[30] Foreign Application Priority Data

Jan. 29, 1997 [JP] Japan ..... 9-015669

[51] Int. Cl.[6] ..... A45D 19/08

[52] U.S. Cl. ..... 4/519; 4/518; 4/515

[58] Field of Search ..... 4/515, 518, 519, 4/523, 520, 522, 516, 517

[56] References Cited

U.S. PATENT DOCUMENTS

| | | | |
|---|---|---|---|
| 3,521,647 | 7/1970 | Mercer . | |
| 3,894,546 | 7/1975 | Nolan | 4/518 |
| 4,081,867 | 4/1978 | Simeola . | |
| 4,411,032 | 10/1983 | Lewy . | |
| 4,901,378 | 2/1990 | Reddell | 4/519 |
| 5,012,534 | 5/1991 | McWhorter | 4/519 |
| 5,528,776 | 6/1996 | Carmichael . | |

FOREIGN PATENT DOCUMENTS

| | | |
|---|---|---|
| 586989 | 3/1994 | European Pat. Off. . |
| 6-022812 | 2/1994 | Japan . |
| 6-22812 | 2/1994 | Japan . |
| 96/21377 | 7/1996 | WIPO . |

*Primary Examiner*—David J. Walczak

*Attorney, Agent, or Firm*—Smith, Gambrell & Russell; Beveridge, DeGrandi, Weilacher & Young Intellectual Property Group

[57] ABSTRACT

In an automatic shampoo machine a recess is formed in a side wall of a basin to ensure water passage to the nape of the neck of a person being shampooed. A plurality of neck support members each including a bent wire arrangement is provided in a spaced relation in the recess. With the neck resting on top portions of the neck support members, the nape of the neck is rinsed by water sprayed from a stationary nape rinsing nozzle, and movable lower nozzles, through the recess. A pad for receiving the neck resting thereon is releasably attached on a peripheral portion of the basin to prevent fatigue of the neck and splashing of rinse water. Thus, the person can have his hair and nape washed in a comfortable posture.

10 Claims, 9 Drawing Sheets

AUTOMATIC SHAMPOO MACHINE

CROSS REFERENCE TO RELATED APPLICATION

This invention is based on an application No. 9-15669 filed in Japan, the content of which is incorporated hereinto by reference.

BACKGROUND OF THE INVENTION

1. Field of the Invention

The present invention relates to an automatic shampoo machine for business use in, for example, barbershops and beauty salons.

2. Description of Related Art

An automatic shampoo machine is conventionally known which includes a basin having an opening at its top and is adapted to spray water in the basin (e.g., Japanese Unexamined Patent Publication No. 6-22812 (1994)). A person to be shampooed inserts his head into the basin with his face upward, so that the person is shampooed in a supine state in this automatic shampoo machine. At this time, his head is supported with his neck rested on the periphery of the basin opening.

Since the periphery of the basin abuts the nape of the neck rested thereon to hide the nape, the water shower does not reach the nape. Therefore, a barber or his assistant has to rinse the nape with the use of a hand-held shower head or the like.

In view of the foregoing, it is an object of the present invention to provide an automatic shampoo machine adapted to automatically wash not only the hair and head skin but also the nape of the neck of a person being shampooed.

SUMMARY OF THE INVENTION

In accordance with the present invention to attain the above mentioned object, there is provided an automatic shampoo machine which comprises: a basin having an opening at its top for receiving the head of a person to be shampooed with his face upward; water spraying means disposed in the basin for spraying rinse water onto the nape of the neck of the person; and a neck support member for supporting the neck with a sufficient space provided for passage of the rinse water sprayed onto the nape.

With this arrangement, the neck support member supports the neck with a sufficient space provided for the water passage to the nape, so that the person being shampooed can have his nape (which may otherwise abut against the periphery of the basin to be hidden thereby) assuredly rinsed in a comfortable position without any pain in his neck.

For example, the neck support member may be located in a position inner than the water passage space within the basin to support an upper nape portion of the neck closer to the head with a sufficient space provided for the water passage to a lower nape portion of the neck. Further, the neck support member may be a bent wire arrangement or a wire net so that the water passage space can be provided more readily. It is preferred that the neck support member of such a configuration is located in the aforesaid position.

The water spraying means includes a special nozzle for spraying the rinse water onto the nape of the neck.

With this arrangement, the nape can fully be rinsed with the rinse water vigorously sprayed thereon, so that the cleanliness after the shampoo is enhanced.

A cushion for resiliently supporting the neck is provided on the periphery of the water passage space.

With this arrangement, the neck can be resiliently supported and, even if the cushion has a narrow contact face, the cushion protects the nape from pain. Since the resilient cushion comes in close contact with the nape, the rinse water vigorously sprayed onto the nape is prevented from trickling down the nape into the back of the person.

Further, the cushion may cover the top of the basin to prevent the rinse water from splashing out of the basin to the outside of the machine.

With this arrangement, the cushion can cover peripheral gaps around the neck thereby to prevent the rinse water from splashing through the peripheral gaps around the neck. Therefore, the ambient environment can be kept clean.

The cushion may be detachable. With this arrangement, the cushion can be replaced depending on the circumference of the neck of the person to be shampooed, so that the splashing of the rinse water can assuredly be prevented. Further, the cleanliness can be enhanced.

DESCRIPTION OF THE PREFERRED EMBODIMENTS

Figure 1:
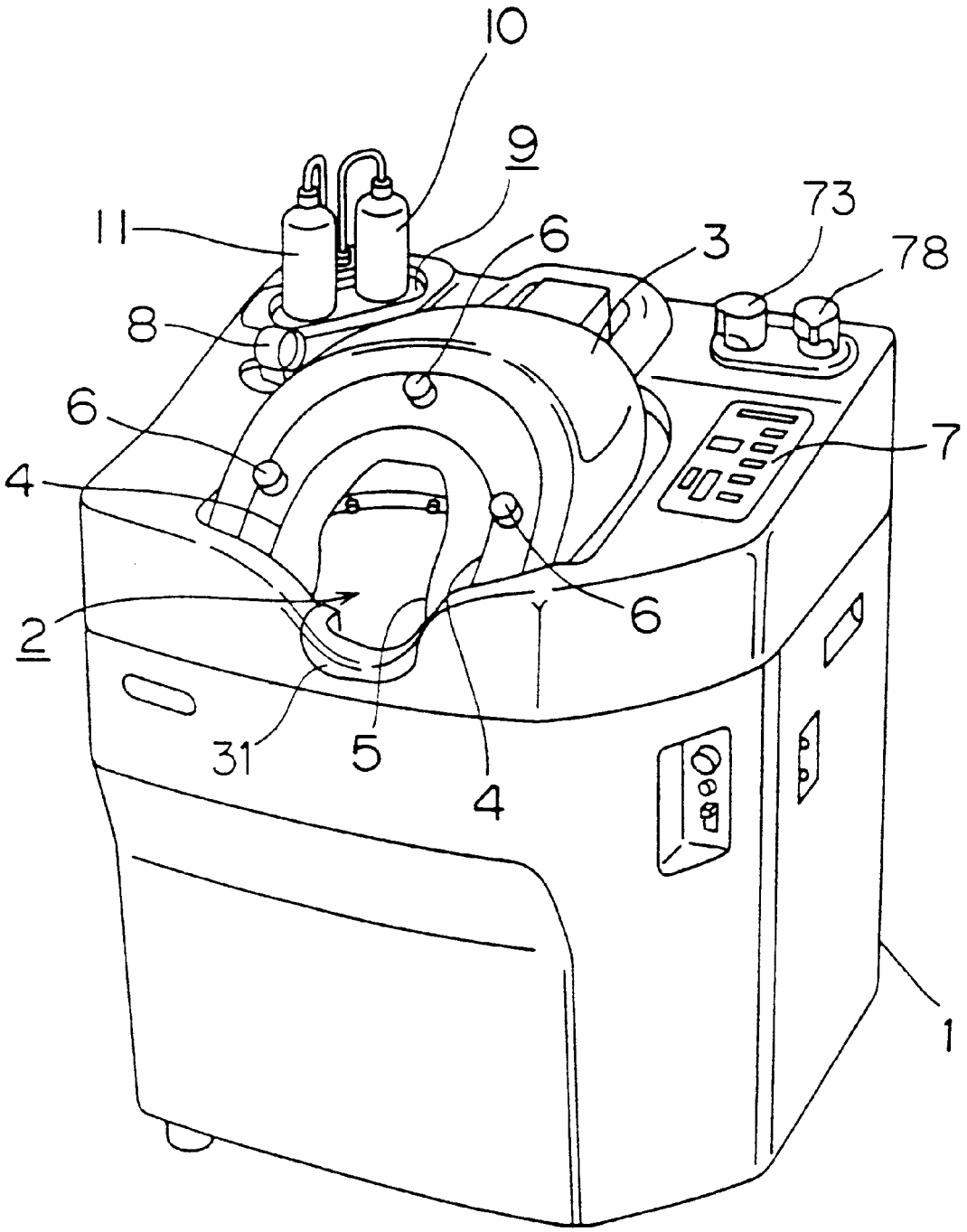
FIG. 1 is a perspective view illustrating the exterior of an automatic shampoo machine according to one embodiment of the present invention.

FIG. 1 is a perspective view illustrating the exterior of an automatic shampoo machine.

The exterior of the automatic shampoo machine is defined by a cabinet 1. The cabinet 1 has an opening formed in a top central portion thereof as an entrance 2 from which a person to be shampooed inserts his head. A basin 60 for receiving the head and hair is disposed below the entrance 2 (see FIG. 2).

The entrance 2 is provided with a hood 3 for covering the periphery of the face of the person to be shampooed. The hood 3 assumes either an open state where the entrance 2 is widely opened or a closed state where the entrance 2 is nearly shut as shown in FIG. 1. The hood 3 has a cut-away portion 4 from which the face of the person is exposed. A face seal 5 is provided on the peripheral edge of the cut-away portion 4, and adapted to come in resilient contact with the face of the person to prevent rinse water from splashing out of the basin onto the face of the person. The projection of the face seal from the peripheral edge of the cut-away portion 4 is adjustable by means of three knobs 6.

The person inserts his head from the entrance 2 in a supine posture with his face exposed from the hood 3 in this automatic shampoo machine. In this state, the person is shampooed with the lower nape portion of his neck resting on a pad 31 attached to a front peripheral portion of the entrance 2.

A control panel 7 is provided, for example, on the right side of the top surface of the cabinet 1. The automatic shampoo machine is operated under control of a controller (not shown) comprising a microcomputer and the like. A hand-held shower head 8 is retractably provided on the left side of the top surface of the cabinet 1. A barber operating the automatic shampoo machine uses the hand-held shower head 8 in finishing the shampoo operation.

A depression 9 is formed in the rear left corner of the top surface of the cabinet 1. A shampoo container 10 containing a shampoo liquid and a treatment container 11 containing a treatment liquid are releasably set in the depression 9. Usable as the shampoo container 10 and the treatment container 11 are those commercially available.

Knobs 73 and 78 for controlling the flow and flow rates of cold water and hot water to be sprayed from the hand-held shower head 8 are provided in the rear right corner of the top surface of the cabinet 1.

Figure 2:
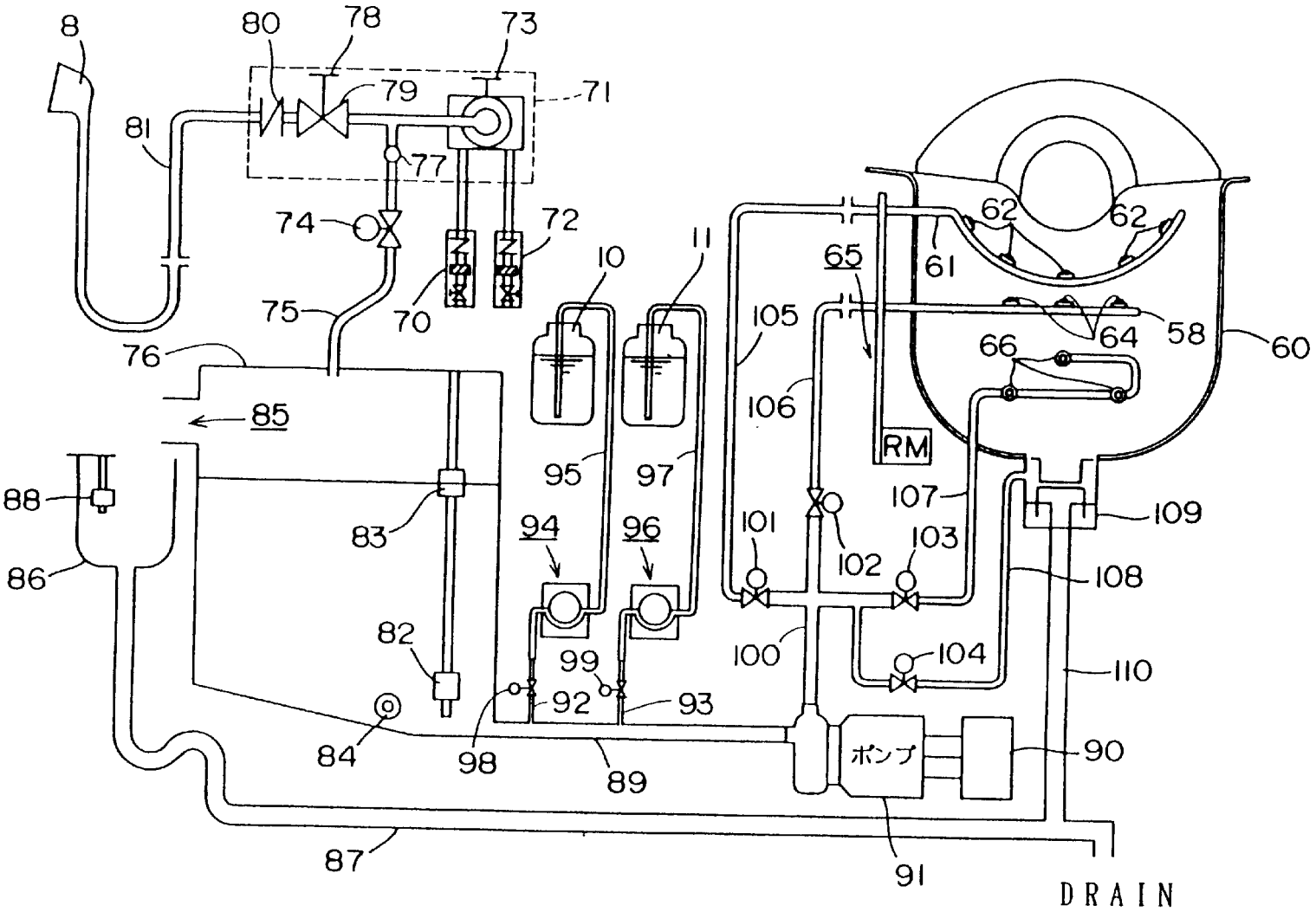
FIG. 2 is a diagram illustrating a water flow channel of the automatic shampoo machine of FIG. 1.

FIG. 2 is a diagram illustrating a water flow channel of the automatic shampoo machine of FIG. 1.

Within the basin 60, upper nozzles 62 and lower nozzles 64 are provided on a generally arcuate upper nozzle link 61 and on a linear lower nozzle link 58, respectively, and stationary nozzles 66 are provided on the side wall of the basin, which will be described later.

There will next be described the water flow channel and a water feeding mechanism for feeding warm water to the respective nozzles.

Cold water fed from a water feed pipe not shown is supplied to a mixing valve 71 through a cold water feeder 70. Hot water fed from another water feed pipe not shown is supplied to the mixing valve 71 through a hot water feeder 72. In the mixing valve 71, the supplied cold water and hot water are mixed into warm water of a proper temperature. The temperature of the warm water prepared in the mixing valve 71 can be adjusted by operating the knob 73 by the operator of the automatic shampoo machine.

The warm water prepared in the mixing valve 71 is supplied to a warm water tank 76 through a water feed pipe 75 upon opening a warm water feed valve 74. A thermistor 77 for sensing the temperature of the warm water supplied from the mixing valve 71 is provided in the water feed pipe 75.

The warm water prepared in the mixing valve 71 is supplied to the hand-held shower head 8 through a check valve 80 and a water feed pipe 81 when the knob 78 is manually operated by the operator of the automatic shampoo machine to open a shower valve 79. As a result, the warm water is sprayed from the hand-held shower head 8. The hand-held shower head 8 is provided for use in the basin 60. More specifically, the hand-held shower head 8 is used for the finishing of the shampoo and for cleaning of the basin 60.

The warm water tank 76 supplied with the warm water prepared in the mixing valve 71 has a volume of 40 liters, for example, in this embodiment. A lower water level sensor 82 and an upper water level sensor 83 for sensing the volume of the warm water stored in the warm water tank 76 are provided in the warm water tank 76. On the basis of outputs of the lower water level sensor 82 and the upper water level sensor 83, the microcomputer controls the opening and closing of the warm water feed valve 74. Thus, the warm water tank 76 is always filled with a proper amount of warm water.

A thermistor 84 for sensing the temperature of the warm water stored in the warm water tank 76 is provided in a lower position of the warm water tank 76.

Provided in an upper position of the warm water tank 76 is an overflow port 85 from which excess warm water is drained out of the warm water tank 76 when warm water is supplied into the warm water tank 76 in an amount greater than a predetermined water volume sensible by the upper water level sensor 83. A drain pan 86 is provided below the overflow port 85. The warm water drained from the overflow port 85 is received by the drain pan 86, and then drained out of the machine through a drain pipe 87 extending from the drain pan 86 to the outside of the machine.

The drain pan 86 has a water level sensor 88 for detection of an abnormal state such that the drain pan 86 is filled with warm water due to reverse flow of warm water once drained into the drain pipe 87.

One end of an outflow pipe 89 is connected to the lower side of the warm water tank 76. The other end of the outflow pipe 89 is connected to a pump 91 driven by an inverter 90. When the pump 91 is driven by the inverter 90, the warm water stored in the warm water tank 76 is sucked into the pump 91 through the outflow pipe 89.

A shampoo liquid supply pipe 92 and a treatment liquid supply pipe 93 are each joined to a middle portion of the outflow pipe 89. The shampoo liquid supply pipe 92 is connected to a pressure feed tube 95 extending from the shampoo container 10 through a shampoo pump 94. The treatment liquid supply pipe 93 is connected to a pressure feed tube 97 extending from the treatment container 11 through a treatment pump 96.

The shampoo pump 94 and the treatment pump 96 squeeze the pressure feed tubes 95 and 97, respectively, so as to suck and feed the shampoo liquid and the treatment liquid contained in the shampoo container 10 and the treatment container 11 through the pressure feed tubes 95 and 97. The shampoo liquid supply pipe 92 and the treatment liquid supply pipe 93 to which the shampoo liquid and the treatment liquid thus fed out are introduced have a shampoo valve 98 and a treatment valve 99, respectively.

When the pump 91 is driven by the inverter 90, the shampoo liquid contained in the shampoo container 10 is supplied to the outflow pipe 89 through the pressure feed tube 95 and the shampoo liquid supply pipe 92 upon opening of the shampoo valve 98. As a result, the shampoo liquid is mixed with the warm water flowing through the outflow pipe 89 to prepare shampoo warm water.

Similarly, when the pump 91 is driven, the treatment liquid contained in the treatment container 11 is supplied to the outflow pipe 89 through the pressure feed tube 97 and the treatment liquid supply pipe 93 upon opening of the treatment valve 99. As a result, the treatment liquid is mixed with the warm water flowing through the outflow pipe 89 to prepare treatment warm water.

The warm water, the shampoo warm water or the treatment warm water sucked into the pump 91 is ejected from an outlet of the pump 91. A branch pipe 100 for guiding the warm water into four pipes is connected to the outlet of the pump 91. The branch ports of the branch pipe 100 are connected to a first feed pipe 105, a second feed pipe 106, a third feed pipe 107 and a fourth feed pipe 108 through an upper nozzle valve 101, a lower nozzle valve 102, a stationary nozzle valve 103 and a drain valve 104, respectively.

A distal end of the first feed pipe 105 is connected to the upper nozzle link 61. A distal end of the second feed pipe 106 is connected to the lower nozzle link 58. A distal portion of the third feed pipe 107 is located on the side wall of the basin 60, and the plurality of stationary nozzles 66 are arranged at predetermined intervals along the distal portion of the third feed pipe 107. A distal end of the fourth feed pipe 108 is connected to a drainage trap 109 connected to a bottom portion of the basin 60. The drainage trap 109 is connected to a drain pipe 110. The drain pipe 110 is further connected to the drain pipe 87.

With this arrangement, the warm water, the shampoo warm water and the treatment warm water can be sprayed from desired nozzles within the basin 60 to automatically shampoo the person by selectively opening the upper nozzle valve 101, the lower nozzle valve 102 or the stationary nozzle valve 103, as required, with the pump 91 driven by the inverter 90.

The upper nozzle link 61 and the lower nozzle link 58 are coupled to a driving mechanism 65 including a link motor RM. During the shampooing operation, the upper nozzle link 61 and the lower nozzle link 58 are moved pivotally and rotatively by the driving mechanism 65 (see FIGS. 3 and 5). AS a result, the water spraying directions in which the warm water is sprayed from the upper nozzles 62 and the lower nozzles 64 are changed, so that the person can be shampooed thoroughly and satisfactorily.

Figure 3:
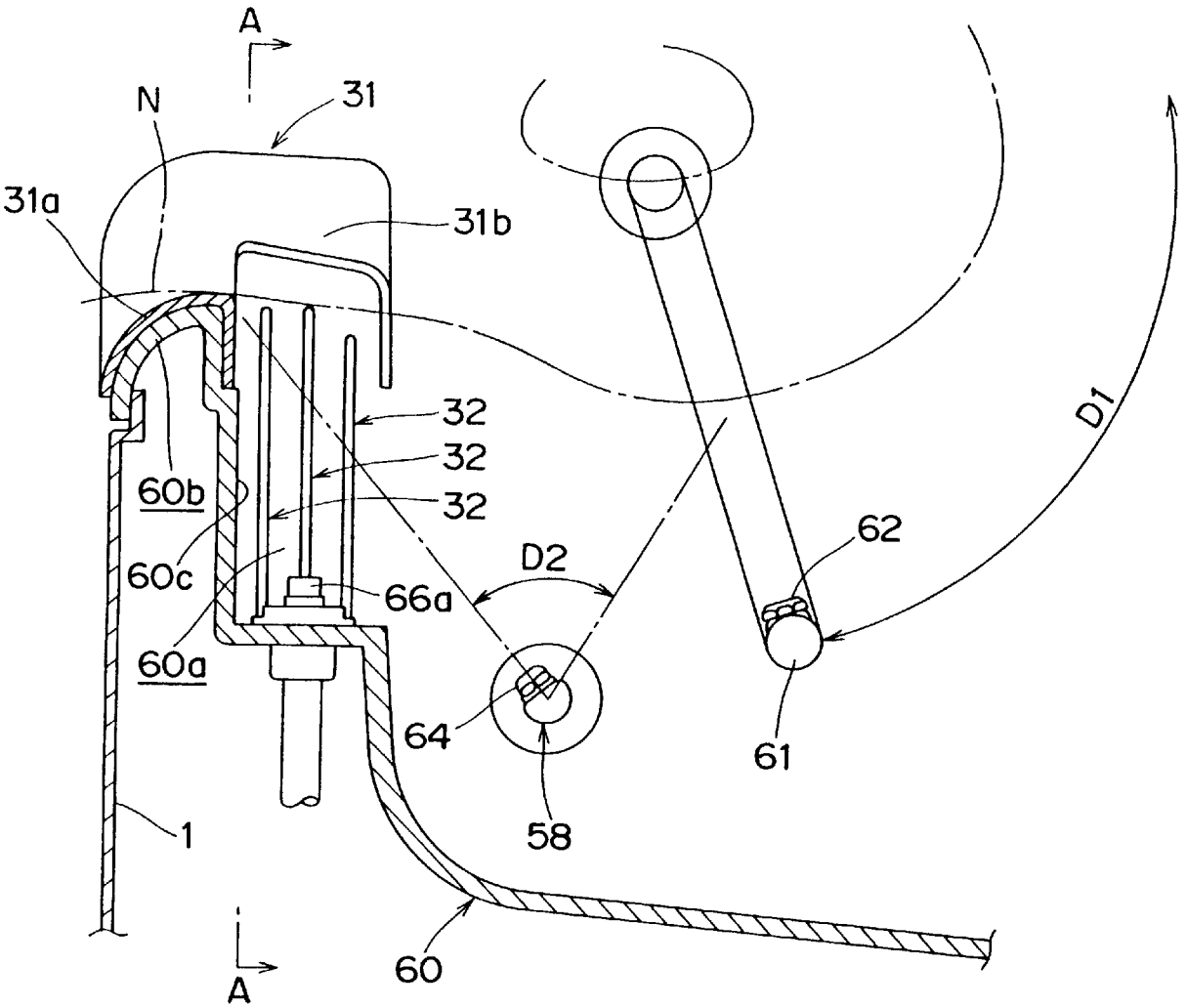
FIG. 3 is an enlarged side view in section illustrating the front portion of a basin of the automatic shampoo machine of FIG. 1.

FIG. 3 is a side view in section illustrating the front portion of the basin of the automatic shampoo machine of FIG. 1.

The upper nozzle link 61 has a generally arcuate shape to conform to the shape of the head of the person, and is pivotal within an angular range D1 in the basin 60. The upper nozzle link 61 has the plurality of upper nozzles 62 for spraying the warm water which are arranged with their nozzle tips directed toward the head of the person.

The lower nozzle link 58 is located below the head in the basin 60, and has a generally linear bar shape. The lower nozzle link 58 is rotatable about its axis within an angular range D2. The lower nozzle link 58 has the plurality of lower nozzles 64 for spraying the warm water which are arranged with their nozzle tips directed toward the head of the person.

The nozzle links 61 and 58 are each rotatably supported at one end thereof by a side wall of the basin 60 in substantially the same manner. An explanation will hereinafter be given to one exemplary construction for the lower nozzle link 58.

Figure 4:
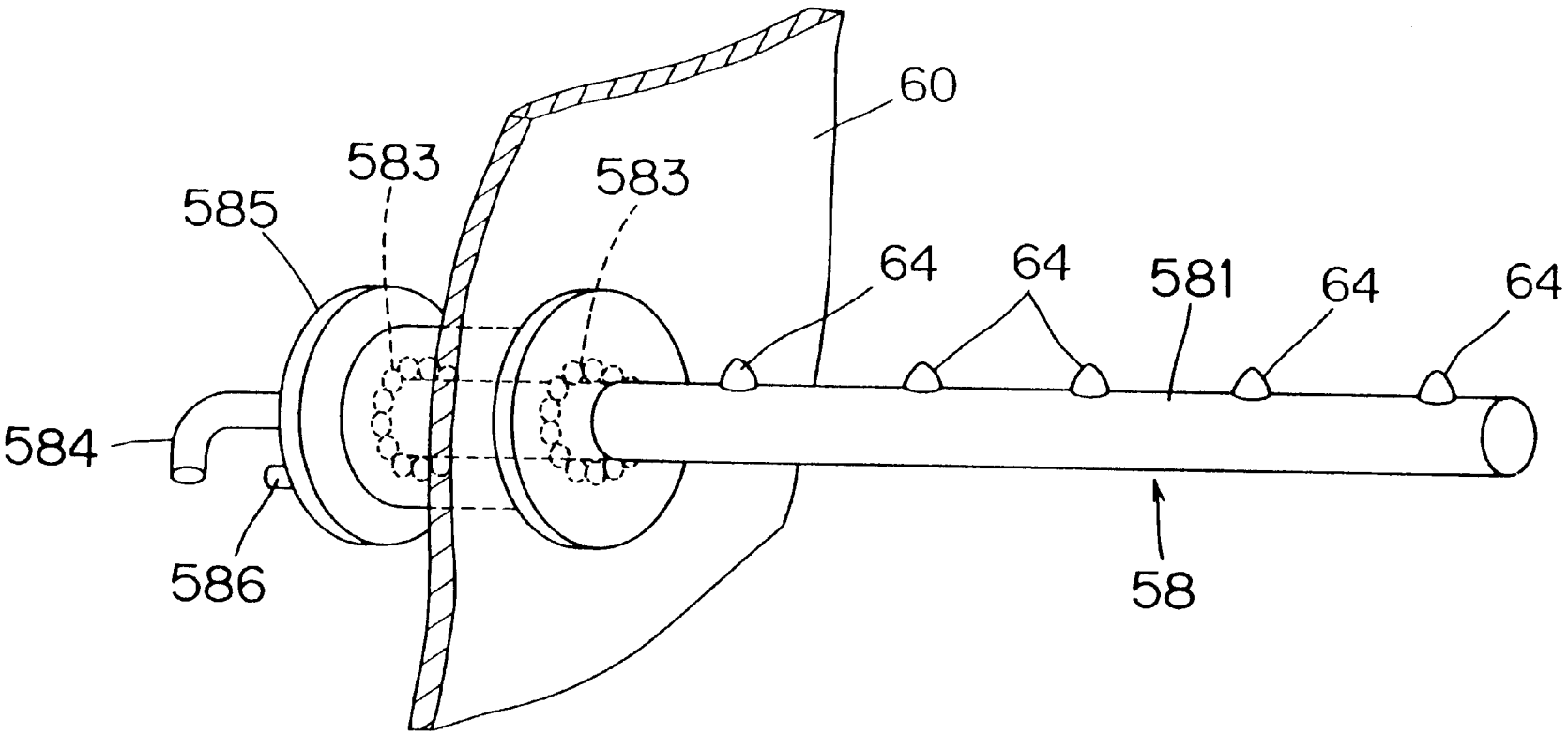
FIG. 4 is a perspective view of a lower nozzle link shown in FIG. 3.

FIG. 4 is a perspective view of the lower nozzle link 58.

The lower nozzle link 58 has a generally linearly extending pipe 581, the distal end of which is a closed free end and the proximal end portion of which extends through the side wall of the basin 60 to the outside of the basin. The proximal end portion of the pipe 581 is rotatably supported via bearing 583 by the side wall of the basin 60. The proximal end of the pipe 581 is connected to a rinse water feed pipe (not shown) through a rotary joint 584. Thus, the rinse water can be supplied to the pipe 581. A pulley 585 is coupled to the proximal end portion of the pipe 581, and has a projection shaft 586 provided eccentrically of the center of the rotation of the pulley 585. When a driving force from a driving mechanism 65 (see FIG. 5) is applied to the projection shaft 586, the pulley 585 is rotated, thereby rotating the pipe 581. Thus, the water spraying direction of the lower nozzles 64 on the pipe 581 can be changed.

Figure 5:
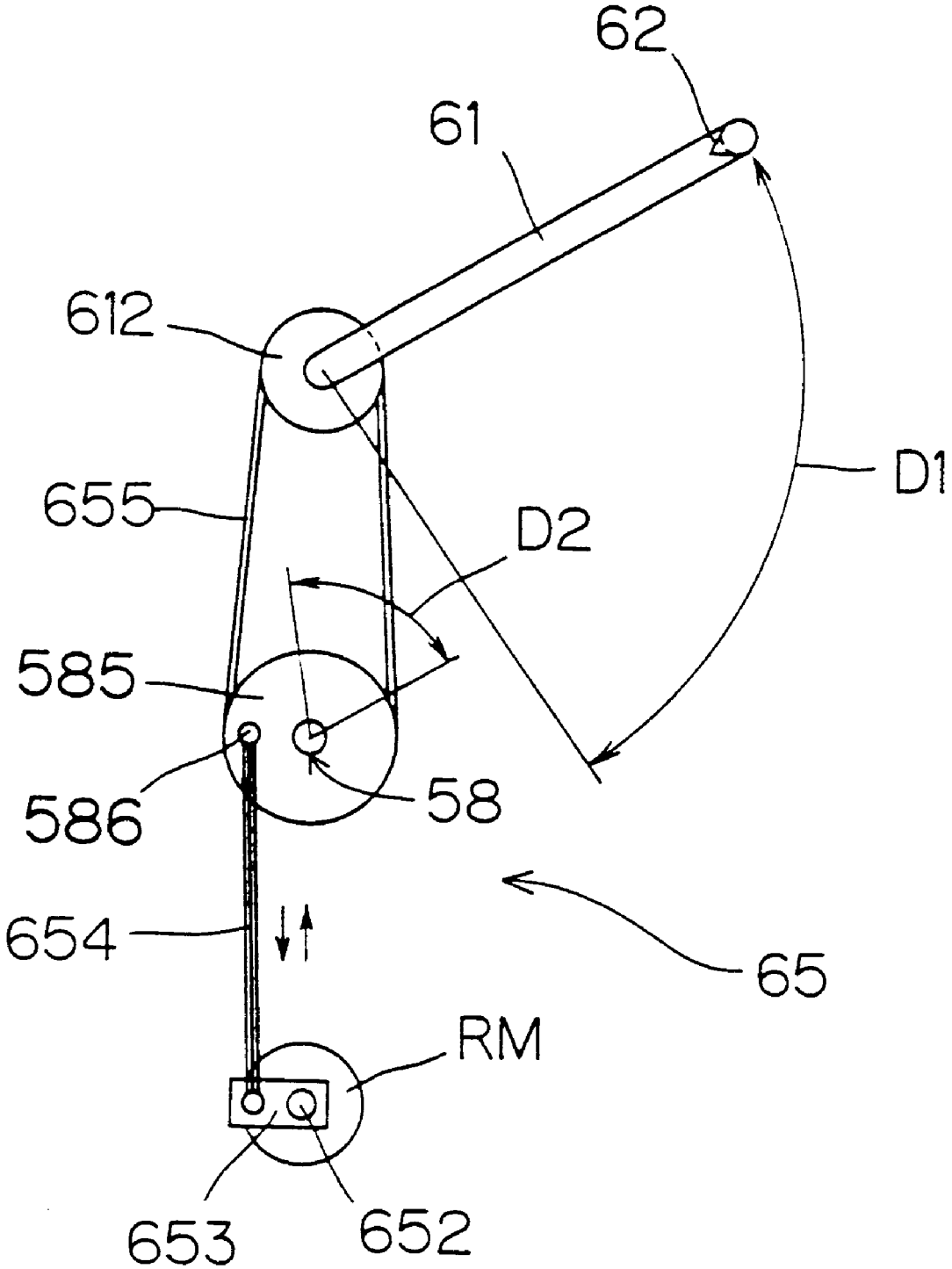
FIG. 5 is a schematic side view of a driving mechanism for the nozzle link shown in FIG. 3.

FIG. 5 is a schematic side view of the driving mechanism for the upper nozzle link 61 and the lower nozzle link 58.

With the driving mechanism 65, the upper nozzle link 61 and the lower nozzle link 58 are driven by the single link motor RM. More specifically, a relatively short arm 653 is attached to a rotation shaft 652 of the link motor RM. The distal end of the arm 653 is rotatably coupled to one end of a link bar 654. The other end of the link bar 654 is rotatably supported by the projection shaft 586 of the pulley 585 of the lower nozzle link 58. The pulley 585 of the lower nozzle link 58 and a pulley 612 of the upper nozzle link 61 are coupled to each other by a belt 655.

The rotation of the link motor RM rotates the arm 653, and the rotational movement of the arm 653 is transformed into a vertical movement of the link bar 654. The vertical movement of the link bar 654 reciprocally rotates the pulley 585 of the lower nozzle link 58 within a predetermined angular range D2. Accordingly, the pipe 581 of the lower nozzle link 58 is reciprocally rotated around its axis within the angular range D2.

The reciprocally rotational movement of the pulley 585 of the lower nozzle link 58 is transmitted to the pulley 612 of the upper nozzle link 61 through the belt 655. As a result, the upper nozzle link 61 is pivoted within a predetermined angular range D1.

The upper nozzle link 61 and the lower nozzle link 58 are respectively pivoted and rotated by the driving mechanism 65 to change the water spray directions in which the warm water is sprayed from the upper nozzles 62 and the lower nozzles 64. Thus, the person can be shampooed thoroughly and satisfactorily.

Figure 6:
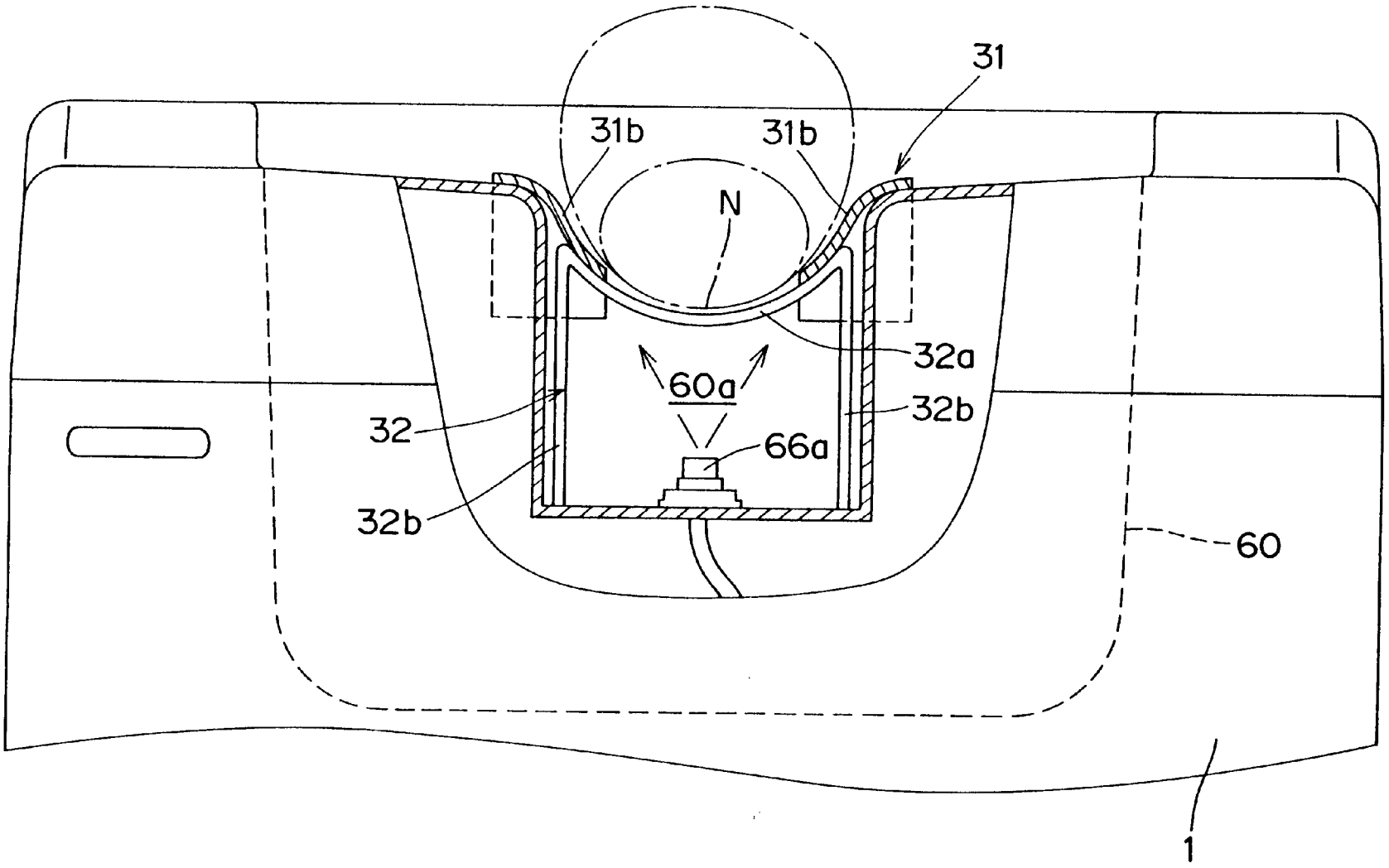
FIG. 6 is a front view in section taken along a line A—A in FIG. 3 and illustrating the front portion of the basin of the automatic shampoo machine of FIG. 1.
Figure 7:
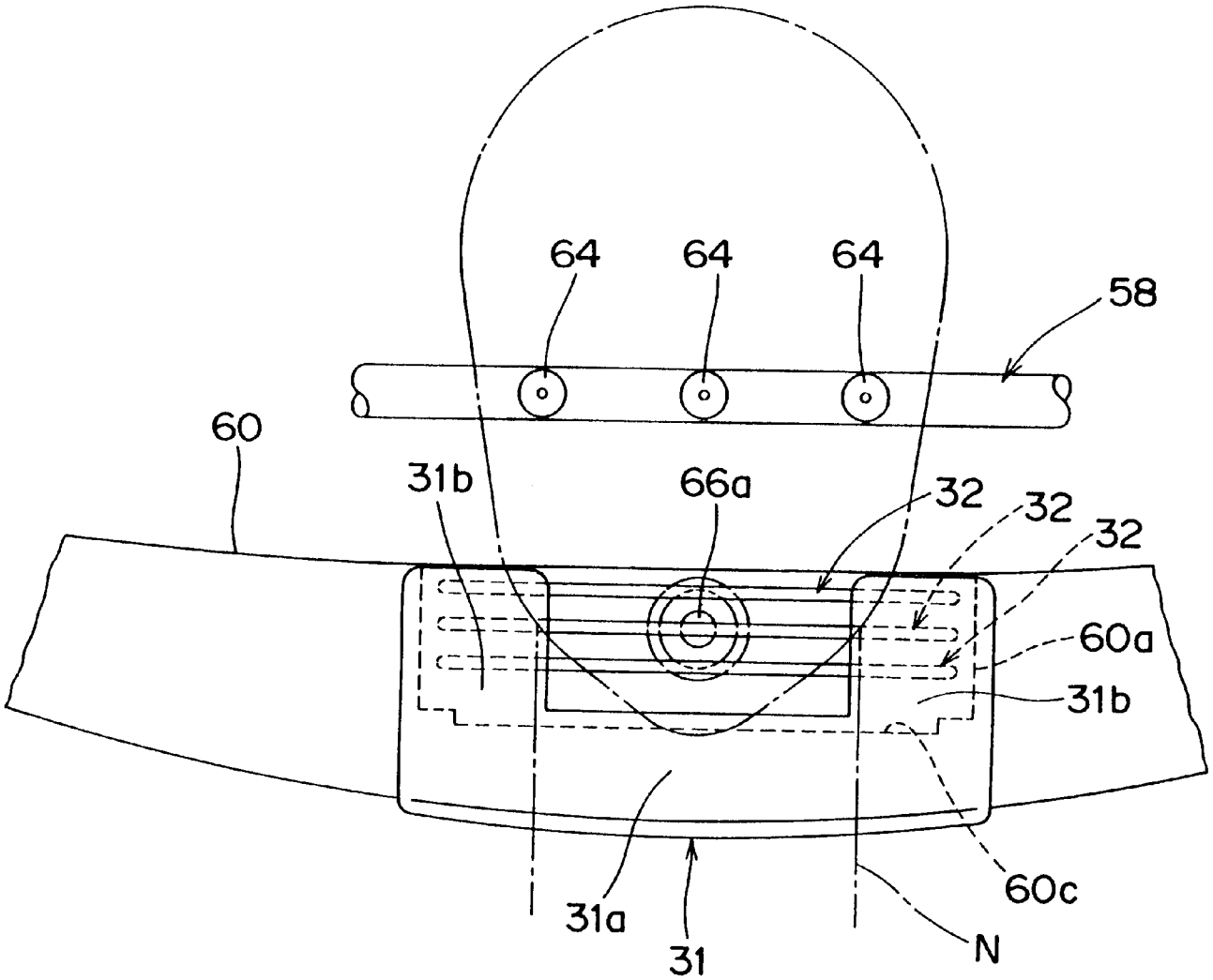
FIG. 7 is a plan view illustrating the front portion of the basin of the automatic shampoo machine of FIG. 1.

FIG. 6 is a front view in section taken along a line A—A in FIG. 3 and illustrating the front portion of the basin of the automatic shampoo machine of FIG. 1. FIG. 7 is a plan view illustrating the front portion of the basin of the automatic shampoo machine of FIG. 1.

The following description refers to FIGS. 3, 6 and 7, in which a portion from the neck N to the head of the person to be shampooed is indicated by a dot-and-dash line.

The basin 60 is of a vessel-like configuration, and has a bottom, a side wall extending upward from the bottom and an open top. The basin 60 includes a rest **60*b* provided on a front upper edge of the side wall for supporting the lower nape portion of the neck, and a recess 60*a* formed on the rear side of the rest 60*b* in the basin 60. A neck support member 32 is provided in the recess 60*a*. The pad 31 as a cushion is releasably attached to the rest 60*b*. A water passage space is defined between the pad 31 and the neck support member 32. The pad 31 and the neck support member 32 receive the neck rested thereon. One of the stationary nozzles 66 serving as a stationary nozzle 66*a* for nape rinsing is located below the neck support member 32. The nape of the neck rested on the pad 31 and the neck support member 32 is rinsed with rinse water sprayed from the stationary nape rinsing nozzle 66*a* and the lower nozzles 64** through the water passage space.

This arrangement will hereinafter be described in greater detail.

The rest **60*b* has a configuration such as to conform to the configuration of the pad 31 as shown in FIG. 1. That is, the rest 60*b* is of a saddle-like shape, having a concavely curved face, as seen from the front side thereof, such that the front middle portion of the upper edge of the entrance periphery of the basin 60 is a little lower than the other portion thereof. The rest 60***b* has a convexly curved face, as seen from a lateral side thereof in FIG. 3, such that the upper edge of the entrance periphery of the basin 60 is a little higher than front and rear portions thereof. The lower nape portion of the neck is rested on the pad 31 provided on the upper face of the rest 60*b*.

The recess 60*a* has an open top, and is such that the front side wall portion of the basin 60 on the rear side of the rest 60*b* is recessed forward in a rectangular shape in plan. When the lower nape portion of the neck is rested on the rest 60*b*, the upper nape portion of the neck closer to the head is faced to the inside of the basin 60 through the recess 60*a*. Therefore, the rinse water from the stationary nape rinsing nozzle 66*a* and the lower nozzles 64 can be directed toward the nape of the neck.

The neck support member 32 is a generally M-shaped metal wire arrangement having a top portion 32*a* on which the neck is rested, and leg portions 32*b* extending downward from the opposite ends of the top portion 32*a* and supporting the top portion 32*a* at a predetermined height. In this embodiment, a plurality of neck support members 32, for example, three neck support members are provided in the recess 60*a*.

The top portions 32*a* of the neck support members 32 are each concavely curved with its middle portion lowered, so as to fit on part of the circumference of the neck to readily support the neck. The neck support members 32 are arranged parallel to each other in such a manner that a resting portion 31*a* of the pad 31 is smoothly followed by the series of the top portions 32*a* of the neck support members 32 each located at a vertical level lowering toward the inner (rear) side of the basin 60. For example, the neck support members 32 may be arranged such that the top portions 32*a* of the two forward neck support members 32 are located at the same vertical level and the top portion 32*a* of the rearmost neck support member 32 is located at a lower vertical level. Thus, the neck can comfortably be rested on the neck support members 32 and the rest 30*b*. Even if the rest 60*b* has a smaller width (as measured from the front edge to the rear edge thereof), the person being shampooed never has a pain in his neck. Since the neck support members 32 each comprise the generally M-shaped metal wire arrangement, the neck can resiliently be supported by the top portions 32*a* thereof. The top portions 32*a* of the neck support members 32 may form a height gradation descendent toward the inner side of the basin 60.

The top portions 32*a* of the neck support members 32 each extend parallel to the side wall 60*c* of the recess 60*a* (in a direction perpendicular to the length of the neck). The neck support members 32 are spaced a predetermined distance from the side wall 60*c* of the recess 60*a* toward the inside of the basin 60, and arranged at predetermined intervals. The predetermined intervals are properly determined so as to ensure that the rinse water sprayed from the stationary nape rinsing nozzle 66*a* and the lower nozzles 64 can reach the nape of the neck rested on the neck support members 32 therethrough.

Thus, the rinse water is sprayed toward the lower nape portion of the neck from the nozzles through the water passage space in the basin 60, while the upper nape portion of the neck is supported on the neck support members 32.

The positions of the lower nozzles 64 and the rotation angle of the lower nozzle link 58 are properly determined so that the rinse water can be sprayed from the lower nozzles 64 toward the upper nape portion of the neck located in an upper position of the recess 60*a*. As the lower nozzle link 58 is rotated, the water can be sprayed from the lower nozzles 64 toward the back of the head and the nape of the neck of the person being shampooed through the water passage space, so that the nape of the neck can thoroughly be rinsed with the water.

The stationary nape rinsing nozzle 66*a* is disposed on the bottom of the recess 60*a* in such a position that the rinse water can be sprayed upward therefrom. The rinse water is sprayed from the stationary nape rinsing nozzle 66*a* toward the nape of the neck through the water passage space. Thus, the nape can be rinsed with the rinse water vigorously sprayed thereto from the stationary nape rinsing nozzle 66*a* and, hence, the cleanliness after the shampoo is enhanced.

The water passage space is defined in the basin 60 as a space through which the rinse water sprayed from the nozzles toward the nape passes. For example, the rinse water from the lower nozzles 64 passes through a front space of the basin 60, a space in the recess 60*a*, a space between the side wall 60*c* and the top portion 32*a* of the neck support member 32 and spaces between the top portions 32*a* of the respective neck support members 32 to reach the nape of the neck. The rinse water from the stationary nape rinsing nozzle 66*a* passes through the space in the recess 60*a* of the basin 60, the space between the side wall 60*c* and the top portion 32*a* of the neck support member 32 and the spaces between the top portions 32*a* of the respective neck support members 32 to reach the nape of the neck.

The pad 31 has the resting portion 31*a* on which the neck is rested, and tongues 31*b* each extending rearward from the resting portion 31*a* to cover the top of the recess 60*a*. The pad 31 is formed of an elastic and water-impermeable material such as rubber.

The resting portion 31*a* has a saddle-like shape to cover the rest 60*b*, and resiliently supports the neck rested thereon. Even if the pad 31 has a small width, the pad 31 can support the neck of the person being shampooed without any pain in his neck. Since the resilient pad 31 comes in close contact with the nape of the neck, the rinse water vigorously sprayed onto the nape is prevented from trickling down the nape into the back of the person being shampooed.

The tongues 31*b* are provided in a pair, and the nape of the neck is exposed to the inside of the recess 60*a* through a gap between the pair of tongues 31*b*. The tongues 31*b* cover the right and left end portions of the top portions 32*a* of the neck support members 32 above the recess 60*a*. Therefore, the tongues 31*b* fill gaps formed on the right and left sides of the neck above the recess 60*a* when the neck is rested on the neck support members 32. Since the tongues 31*b* of the pad 31 cover the peripheral gaps around the neck, the rinse water is prevented from splashing through the peripheral gaps around the neck. This prevents the rinse water from wetting the surrounding floor and the clothes of the person being shampooed to keep the ambient environment clean.

The size of the neck varies from person to person, and there is a possibility that the peripheral gaps around the neck cannot fully be covered with the pad 31, if the pad 31 has an improper size. In this embodiment, the pad 31 is detachable. For example, the resting portion 31*a* of the pad 31 is detachably fitted in the rest 60*b* of the basin 60. Pads 31 of various sizes may be prepared for replacement thereof depending on the size of the neck of the person to be shampooed. Thus, the splashing of the water can assuredly be prevented regardless of the neck size of the person to be shampooed. For example, pads 31 of large, medium and small sizes having pairs of differently spaced tongues 31*b* are prepared for persons having large, standard and small neck sizes. The replaceable pad 31 is sanitary, and enhances the cleanliness.

In accordance with this embodiment, the water passage space is provided between the neck support members 32 and the side wall of the basin 60, and the upper nape portion of the neck can be supported on the neck support members 32. Therefore, the person being shampooed can have his nape (which may otherwise abut the periphery of the basin 60 to be hidden thereby) fully rinsed in a comfortable posture without any pain in his neck. Without the provision of the neck support members 32, only the lower nape portion of the neck is supported by the periphery of the basin 60, so that the person being shampooed may have fatigue in his neck. Therefore, the provision of no neck support member is not preferable.

Since the neck support members 32 each comprise a bent wire arrangement or a wire net, nothing blocks the passage of the rinse water below the neck support members 32 so that the space for the water passage to the neck can readily be provided.

Although the stationary nape rinsing nozzle 66*a* and the movable lower nozzles 64 are provided for rinsing the nape in the aforesaid embodiment, either the stationary nape rinsing nozzle 66*a* or the lower nozzles 64 may be provided.

Figure 8:
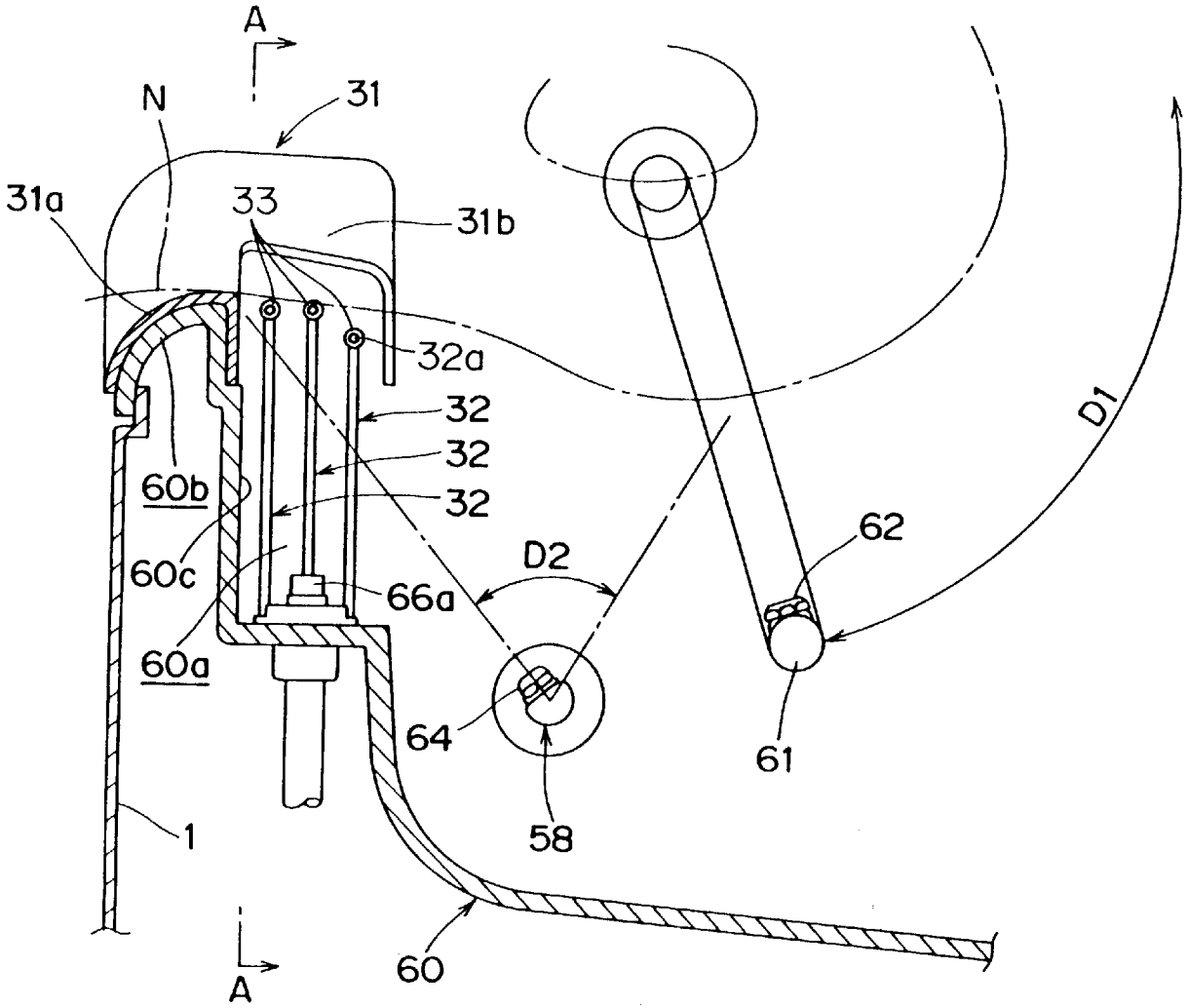
FIG. 8 is an enlarged side view in section illustrating the front portion of a basin of an automatic shampoo machine according to another embodiment of the present invention.

In the aforesaid embodiment, the cushion is provided only on the rest 31*b* but not on the neck support members 32. This arrangement is not critical. For example, pads 33 may be provided on the top portions 32*a* of the neck support members 32 as shown in a sectional side view of FIG. 8. The pads 33 are each comprised of a tubular material with a C shape in section having a linear incision extending along the length thereof. The top portion 32*a* of the neck support member 32 is inserted in the hollow portion of the tubular material from the incision so as to be releasably fitted therein. The pads 33 are each formed of a soft material serving as a cushion so that the neck can resiliently be supported thereon.

Figure 9:
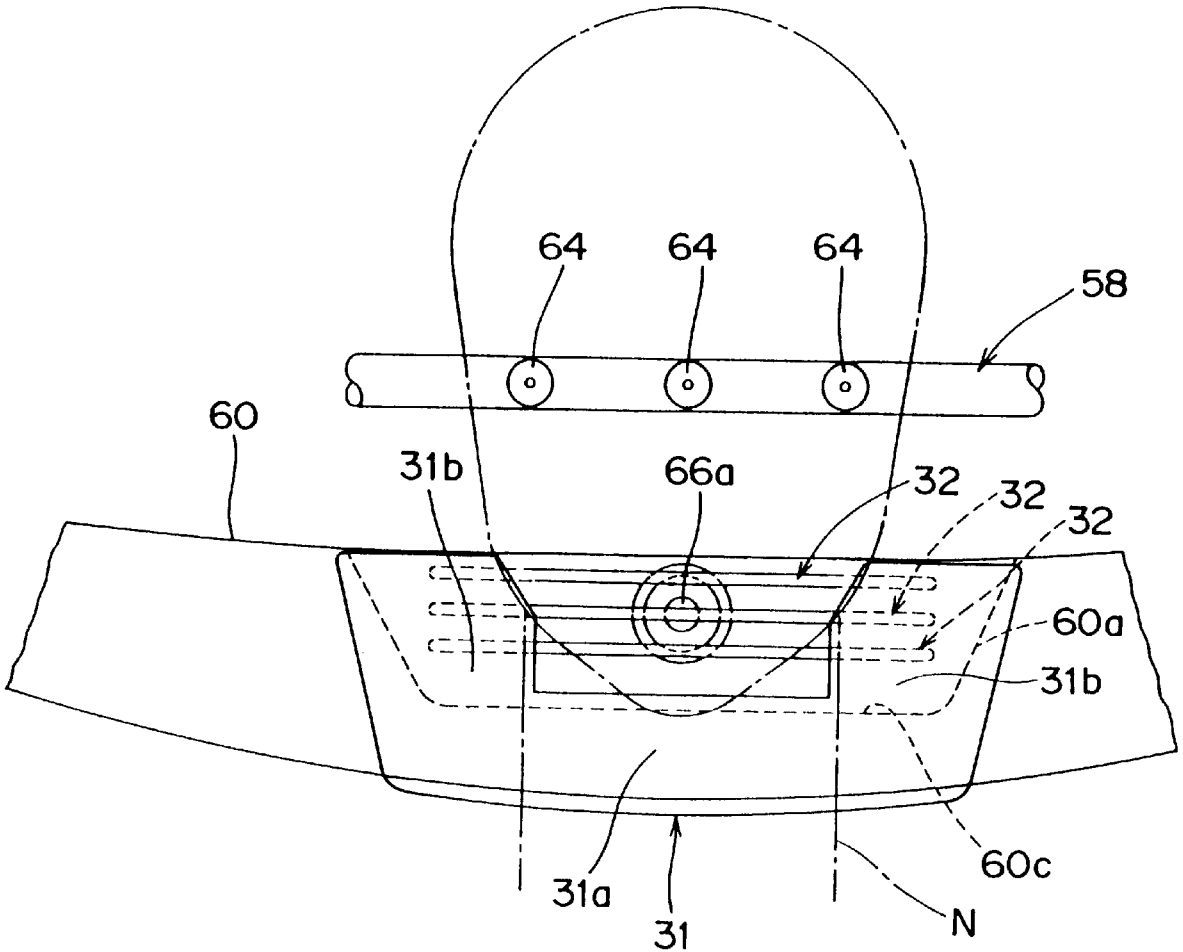
FIG. 9 is a plan view illustrating the front portion of a basin of an automatic shampoo machine according to still another embodiment of the present invention.

The shape of the pad 31 is not limited to that described above. For example, the tongue 31*b* is not limited to that having a rectangular shape in plan as shown in FIG. 7, but it is more preferable that the tongue 31*b* has a shape which conforms to the shape of the neck as shown in a plan view of FIG. 9.

The recess 60*a* is provided in the basin 60 as the water passage space through which the rinse water sprayed from the respective nozzles toward the neck passes, but this arrangement is not critical. Although the recess 60*a* is such that the front side wall portion of the basin 60 is recessed forward in a rectangular shape in plan, the recess 60*a* may be such that the front side wall portion of the basin 60 is taperingly recessed forward in a trapezoidal shape in plan to conform to the shape of the neck, particularly, the shape of the upper nape portion of the neck. With such an arrangement, the rinse water can readily be sprayed onto the nape of the neck from the respective nozzles in the basin 60. Further, the provision of the recess 60*a* in the basin 60 is not necessarily required, but the critical requirement is to ensure that the rinse water be readily sprayed onto the nape of the neck.

The structure of the neck support member 32 is not limited to that described above. For example, the neck support member 32 may be a bent wire arrangement similar to that described above but having a top portion extending parallel to the length of the neck. Alternatively, the neck support member 32 may comprise a pair of ribs formed integrally with the basin 60 and a rest provided on the ribs for receiving the neck rested thereon, and the water passage space through which the rinse water passes is defined between the pair of ribs. Alternatively, a mesh member capable of supporting the neck may be provided as the neck support member 32 above the recess 60*a*, so that the rinse water is supplied through openings of the mesh member. Further, a member having a multiplicity of openings and capable of receiving the neck rested thereon may be used instead of the mesh member.

What is claimed is:

1. An automatic shampoo machine comprising:

a basin having an opening at a top for receiving a head of a person to be shampooed with the person's face upward;

a rest for supporting a lower nape portion of a neck of the person provided on a front upper edge of a side wall of the basin;

a neck support for supporting the neck, the neck support being located in the basin and being spaced a predetermined distance from the rest toward the inside of the basin to define a space therebetween to permit passage of rinse water sprayed toward the nape;

a first water spray means disposed in the basin for spraying rinse water toward the space between the rest and the neck support; and a second water spray means for spraying rinse water toward the head.

2. An automatic shampoo machine as set forth in claim 1, wherein the neck support also defines a space for passage of the rinse water sprayed toward the nape.

3. An automatic shampoo machine as set forth in claim 2, further comprising cover means for covering peripheral gaps formed around the neck above the space, for preventing splash of rinse water through the peripheral gaps around the neck.

4. An automatic shampoo machine as set forth in claim 3, wherein the cover means comprises a pair of tongues extended from a pad attached on the rest.

5. An automatic shampoo machine as set forth in claim 4, wherein the pad is detachable.

6. An automatic shampoo machine as set forth in claim 2, wherein the neck support is a generally M-shaped metal wire arrangement having a top portion on which the neck is rested.

7. An automatic shampoo machine as set forth in claim 2, wherein the neck support comprises a plurality of neck support members each made of a generally M-shaped metal wire arrangement having a top portion on which the neck is rested.

8. An automatic shampoo machine as set forth in claim 7, wherein the neck support members are arranged at predetermined intervals.

9. An automatic shampoo machine as set forth in claim 8, wherein the top portions of the neck support members each are concavely curved respectively with a middle portion lowered.

10. An automatic shampoo machine as set forth in claim 1, further comprising cover means for covering gaps formed on right and left sides of the neck above the space between the rest and the neck support when the neck is resting on the rest and the neck support.

* * * * *